United States Patent [19]

Tu

[11] Patent Number: 4,807,844

[45] Date of Patent: Feb. 28, 1989

[54] UNITARY MOLD FOR MAKING ICE SCULPTURE

[76] Inventor: Chen-Hua Tu, P.O. Box 10160, Taipei, Taiwan

[21] Appl. No.: 172,658

[22] Filed: Mar. 24, 1988

[51] Int. Cl.[4] ..... F25C 1/22

[52] U.S. Cl. ..... 249/78; 249/55; 249/58; 249/80; 249/134; 249/141; 249/144; 249/183; 249/184; 425/DIG. 44

[58] Field of Search ..... 249/55, 58, 63, 78, 249/79, 82, 112, 127, 134, 141, 144, 145, 151, 176, 175, 184, 80, 135, 153, 183; 425/DIG. 44

[56] References Cited

U.S. PATENT DOCUMENTS 3,059,281 10/1962 Visser et al. ..... 249/78
3,980,269 9/1976 Maurino et al. ..... 249/127
3,998,422 12/1976 Putzer ..... 249/127
4,055,620 10/1977 Conrad ..... 425/DIG. 44
4,093,175 6/1978 Putzer et al. ..... 249/153

*Primary Examiner*—Jay H. Woo
*Assistant Examiner*—James C. Housel

[57] ABSTRACT

A unitary mold for making ice sculpture includes: a mold made of elastomer material having an inner cavity concave downwardly for forming a model of an ice sculpture such as an animal, a building or a person or an article; a perforating bar or needle poking through the mold which can be warmed up to slightly melt the ice surrounding the bar or needle for its easy withdrawal from the ice product and forming a through hole of the ice sculpture for decorative, carrying, or water-drainage purposes; and an expansion-releasing element such as a flip-flop member formed as a part of the mold, serving as a buffer for the expansion of the water during its refrigeration process.

3 Claims, 3 Drawing Sheets

UNITARY MOLD FOR MAKING ICE SCULPTURE

BACKGROUND OF THE INVENTION

Conventional ice sculptures such as to mimic an animal, a famous building, or a wellknown person are generally made by manual sculpturing, which however requires craftsmanship and may cause higher preparation cost.

It is also well known to implement a metallic mold to make ice products, but merely for producing simple geometric structures such as cubic or spherical shapes, rather than the complex styles of artistic features.

The present inventor has found such phenomena and invented the present unitary mold for making ice sculpture.

SUMMARY OF THE INVENTION

The object of the present invention is to provide a unitary mold for making ice sculpture including a main mold made of elastomer having an inner cavity for making a model ice sculpture, an expansion releasing means selected from a flip-flop member or an over-flow groove provided for a buffer of an expansion volume exerting during a refrigeration process of the water filled in the mold cavity, and a perforating means selected from a hollow bar or a heating needle pre-inserted through the mold so that once the water is frozen to become ice, the molded sculpture is released from the mold and the perforating means is withdrawn from the mold and the ice product by passing warm water through the hollow bar or by heating the needle to slightly melt the ice surrounding the bar or needle for its easier removal.

DETAILED DESCRIPTION

Figure 1:
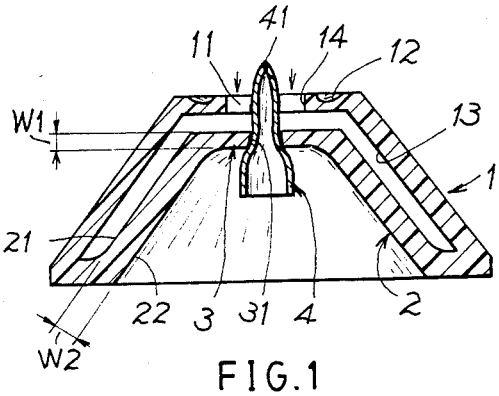
FIG. 1 is a sectional drawing of the present invention.

The present invention comprises: a main mold 1, a core 2, an expansion-releasing means 3, and a perforating means 4 for making an ice sculpture 5.

Figure 2:
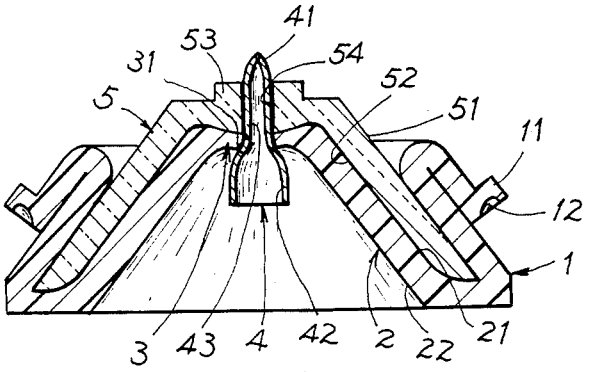
FIG. 2 is a sectional illustration showing the releasing of the finished ice sculpture from the mold in accordance with the present invention.
Figure 3:
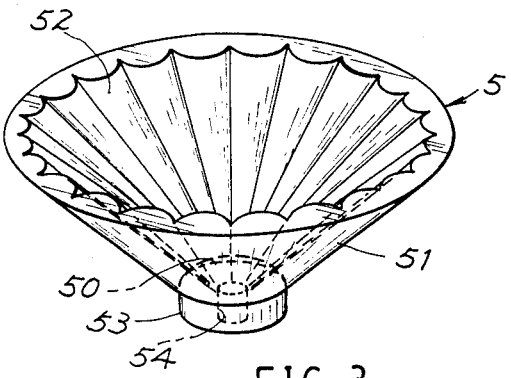
FIG. 3 shows a finished ice sculpture in accordance with the present invention.

As shown in FIGS. 1, 2 and 3, the main mold 1 includes: a filling port 11 formed on its upper central portion for filling water through the port 11 into the mold, a divesting flange 12 fromed on an upper portion of the mold 1, a first cavity 13 concave downwardly from the filling port 11 for making a main model of the molding model, and a second cavity 14 communicated with the first cavity 13 for making an attachment portion of the main model.

The core 2 is secured to the main mold and convex upwardly to confine a partition space between the first cavity 13 and an outer circumference 21 of the core 2, adapted for filling water for the ice making. The mold 1 and core 2 may be made of elastomer material, such as a silicon rubber. Inside the core 2, there is formed a hollow portion 22 for a downward pulling of the core for easy releasing of the molded ice product.

The expansion-releasing means 3 is a flip-flop member 3 made of elastomer material such as a silicon rubber and is formed as a part of the core 2 as shown in FIG. 1, in which the flip-flop member 3 has a thickness w1 smaller than a thickness w2 of the core or mold material. Such a flip-flop member 3 can also be formed as a part of the main mold 1 and formed on a suitable position on the mold 1.

The perforating means 4 includes a hollow bar 41 and a handle portion 42 secured with the bar 41, both bar 41 and handle portion 42 having an inner through hole 43 formed therethrough. In FIG. 1, the perforating means 4 passes through a hole 31 of the flip-flop member 3. The size of the hole 31 may be slightly smaller than that of the bar 41 so that a water tightness and sealing purpose can be effected by the member 3 made of silicon rubber.

When using the present invention, water is fed through the filling port 11 into the cavities 13, 14 of the mold 1 wherein the perforating bar 4 is pre-inserted into the hole 31 as shown in the figures and the complete mold is then put into a refrigerator for freezing the water to be an ice. During the refrigeration of water, an expansion of the water/ice volume may cause a flip-flop action to force the member 3 downwardly as shown in FIG. 2 thereby releasing the expansion of the ice and preventing a deformation of the molded shape of the ice sculpture 5 which is a shallow bowl as shown in FIG. 3. After the refrigeration process is finished, by pulling the divesting flange 12 outwardly to release the modl 1 and pulling the core 2 downwardly to release the core 2 and by filling warm water into the hole 43 to slightly melt the ice surrounding the bar 41 for its easy removal from the ice product and after withdrawing the bar 41, an ice sculpture of bowl is present which is then turned over as shown in FIG. 3. The ice sculpture of a bowl 5 includes a main moded 51, an inner socket 52 for storing fresh foods therein, an attachment portion 53 such as a supporting base formed under the main model 51 and a drain hole 54 is formed inside the attachment portion 53 for draining ice water from the wall of the socket 52. Such a drain hole 54 is formed due to the withdrawal of the perforating bar 41 as aforementioned.

Figure 5:
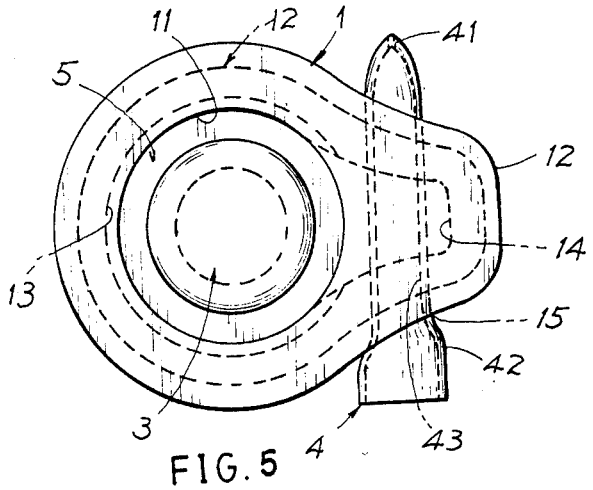
FIG. 5 is a top-view illustration of FIG. 4 of the present invention.
Figure 4:
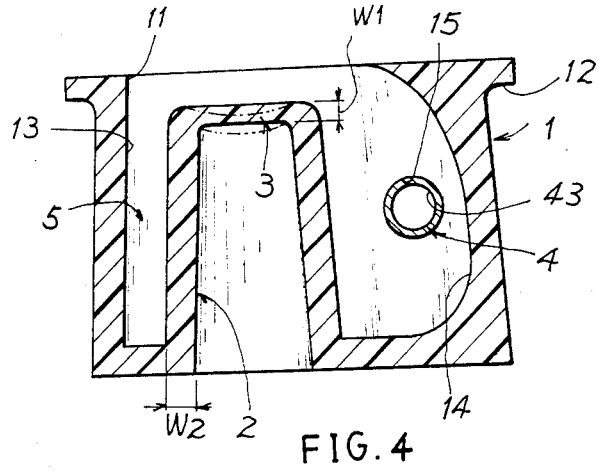
FIG. 4 is a sectional drawing of another preferred embodiment of the present invention.
Figure 6:
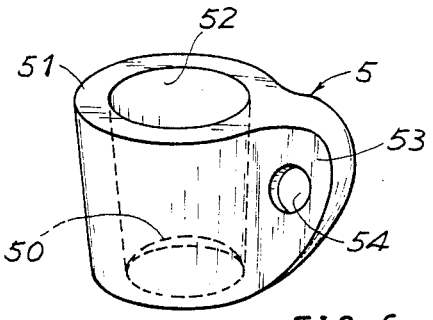
FIG. 6 is a perspective view of the finished product released from the mold of FIG. 4.

Another preferred embodiment of the present invention is shown in FIGS. 4, 5 and 6, which is modified for making a cup 5 having a main model 51 of cup body having an inner socket 52, an attachment portion 53 having a finger-grasping hole 54 by withdrawing the bar 41, except the bar 41 being inserted through two side holes 15 formed on the main mold 1.

Figure 7:
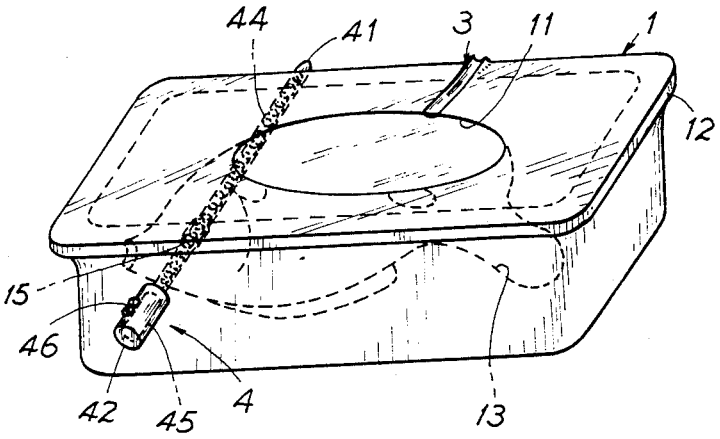
FIG. 7 shows still another preferred embodiment of the present invention.
Figure 8:
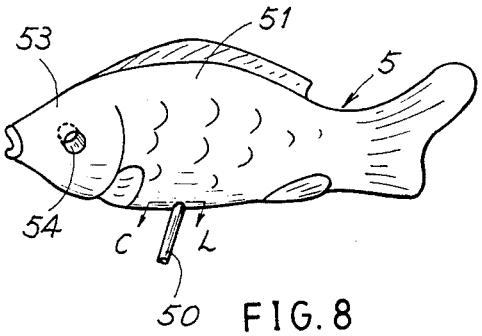
FIG. 8 is a finished product as released from the mold of FIG. 7.

Still another preferred embodiment of the present invention is shown in FIGS. 7 and 8, which comprises: a main mold 1 having a filling port 11 formed on an upper portion of the mold 1, a divesting flange 12 formed on an upper portion of the mold 1 and an inner cavity 13 concave downwardly for making a main model 51 (a fish body) and an attachment portion 53 (a fish head) of an ice sculpture 5 as shown in FIG. 8; an expansion-releasing means 3 which is formed as an inclined over-flow groove protruding outwardly and gradually upwardly from the port 11 as shown in FIG.

7; and a perforating means 4 having a hollow needle 41 provided with heating coil 44 therein poking through two eye holes 15 formed on the mold 1, and a handle portion 42 provided with dry cell 45 therein and switch 46 thereon for on-off control of the power source from the cell 45.

After the refrigeration step is finished, the ice fish is divested from the mold 1, any expanding ice stick 50 is cut along a cutting line C as shown in Fig.8 and the needle 41 is withdrawn from the fish head 53 by turning on the heating coil 44 inside the needle 41 to slightly melt the ice surrounding the needle so that the needle 41 is easily withdrawn from the ice fish to become optically bright eyes 54 of a fish as shown in FIG. 8. For simple and mini fish, such as for eating purpose, the needle 41 and the groove 3 can be omitted to obtain the production convenience.

The hollow bar 4 as used in FIGS. 1 and 5 can be made of metallic material or silicon rubber having good thermal conductivity.

Other modification can be made or derived from the aforementioned without departing from the claiming scope of this application.

I claim:

1. A unitary mold for making ice sculpture comprising:

a main mold made of elastomer material having a filling port formed on an upper portion of said mold for filling molding water into the mold, a divesting flange formed on an upper portion of the main mold for pulling the main mold outwardly for releasing a molded ice sculpture therefrom, a first cavity defining surface concave downwardly from the filling port for making a main surface of the ice sculpture, and a second cavity defining surface communicating with said first cavity for making an attachment portion of the ice sculpture;

a core made of elastomer material having an outer circumferential surface convex upwardly to confine a partition space between said first cavity defining surface of said main mold and said core for making a wall of the ice sculpture, said core being secured to said main mold;

an expansion-releasing means being a part of the mold serving as a buffer for the expansion volume of the water when refrigerated in a cooler; and a perforating means for forming a hole through the ice sculpture having a hollow bar inserted through the mold, a handle portion secured with said hollow bar and a through hole formed through said handle portion and said bar for filling warm water through said through hole for slightly melting the ice surrounding the bar for easy withdrawal of the bar from an ice sculpture.

2. A unitary mold for making ice sculpture comprising:

a main mold having a filling port formed on an upper portion of said mold, a divesting flange formed on an upper portion of said mold, and an inner cavity, concave downwardly from said filling port;

an expansion-releasing means formed as an over-flow groove protruding outwardly and slightly upwardly from said filling port for the expansion of water as filled in said mold during a refrigeration of the water; and a perforating means having a hollow needle poking through the main mold having heating coil formed therein and a handle portion secured with said needle and having a dry cell provided in said handle portion and an on-off switch provided on said handle so that upon a turn-on of the switch to power the heating coil, the ice surrounding the needle will be slightly melted for an easy withdrawal of the needle for forming a through hole of the molded ice sculpture.

3. A unitary mold for making ice sculpture comprising: a main mold of silicon rubber having a filling port formed on an upper portion of said mold, a divesting flange formed on an upper portion of said mold, and an inner cavity defining surface concave downwardly from said filling port; an expansion-releasing means being a part of the mold serving as a buffer for the expansion volume of the water when refrigerated in a cooler; and a perforating means for forming a hole through the ice sculpture, the improvement which comprises:

said expansion-releasing means being formed as an inclined over-flow groove protruding outwardly and gradually upwardly from the filling port and said perforating means having a hollow needle provided with heating coil therein poking through two eye holes formed in the mold, and a handle portion provided with dry cell therein and switch thereon for on-off control of the power source from the cell.

* * * * *